US007836614B2

(12) United States Patent
Parker

(10) Patent No.: US 7,836,614 B2
(45) Date of Patent: Nov. 23, 2010

(54) RECHARGEABLE SNOW REMOVAL DEVICE AND ASSOCIATED METHOD

(76) Inventor: Mary Ann Parker, P.O. Box 440098, Chicago, IL (US) 60644

( * ) Notice: Subject to any disclaimer, the term of this patent is extended or adjusted under 35 U.S.C. 154(b) by 73 days.

(21) Appl. No.: 12/321,043

(22) Filed: Jan. 15, 2009

(65) Prior Publication Data

US 2010/0037491 A1 Feb. 18, 2010

Related U.S. Application Data

(60) Provisional application No. 61/189,126, filed on Aug. 15, 2008.

(51) Int. Cl.
*E01H 5/09* (2006.01)

(52) U.S. Cl. ..... 37/246

(58) Field of Classification Search ..... 37/196, 37/241–246, 248, 221, 222, 227, 250–257; 56/11.9, 2, 1, 12.1, 12.7; 180/68.5; 318/139, 318/599, 811

See application file for complete search history.

(56) References Cited

U.S. PATENT DOCUMENTS 3,468,041 A 9/1969 Mattson
4,190,972 A 3/1980 Berner
4,597,203 A * 7/1986 Middleton ..... 37/241
5,787,693 A * 8/1998 Dyke ..... 56/11.9
6,170,179 B1 1/2001 Paytas
6,170,241 B1 * 1/2001 Shibilski et al. ..... 56/11.9
6,938,364 B2 * 9/2005 White et al. ..... 37/248
7,343,994 B2 * 3/2008 Wakitani et al. ..... 180/65.265
7,482,768 B2 * 1/2009 Lucas et al. ..... 318/139

* cited by examiner

*Primary Examiner*—Robert E Pezzuto

(57) ABSTRACT

A rechargeable snow removal device for displacing snow from a variety of locations may include a portable frame with a plurality of wheels. Further, the device may include a primary snow intake section connected to a front end of the frame, a power-actuated vacuum mechanism, and an exhaust nozzle for discharging snow away from the frame. Also, the device may include first and second power sources, preferably a power cord and rechargeable battery respectively. A mechanism for directing and interrupting power from the first and second power sources to the vacuum mechanism may also be included, such that the device may continuously receive power from at least one source. A power distribution interface may be controlled by a user interface and may operate a plurality of switches to direct power from the sources accordingly. Additionally, an auxiliary snow intake section may be included for collecting snow in limited space areas.

12 Claims, 7 Drawing Sheets

RECHARGEABLE SNOW REMOVAL DEVICE AND ASSOCIATED METHOD

CROSS REFERENCE TO RELATED APPLICATIONS

This application claims the benefit of U.S. Provisional Application No. 61/189,126, filed Aug. 15, 2008, the entire disclosure of which is incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to snow removal devices and, more particularly, to a rechargeable snow removal device for displacing snow from a variety of locations.

2. Prior Art

There has long been a need for a light and easily maneuverable snow remover. Such a need is progressively increasing because of our increasing urban population and our increasing numbers of people who live in townhouses and condominiums. The public has long had available to it the heavy duty two stage snow throwers in which an auger is driven by a gasoline engine, the auger feeding the snow to a fan which in turn blows the snow in the direction desired.

These conventional types of snow throwers are very large, very heavy, expensive and difficult to operate and manipulate. In fact, these conventional two stage snow throwers are virtually impossible to be operated by older people, young people and those who are not very strong. Furthermore, these heavy two stage snow throwers are difficult to store. Because of this, they normally must be kept in cold environments such as garages and the like, which in sub-zero temperatures often makes them difficult to start. One factor that makes most snow removers heavy is the need to use gasoline in order to operate the snow remover. A large fuel storage tank is needed to allow a user to operate the device for a suitable amount of time. When filled to capacity, the gasoline only adds to the overall weight of the snow removal device.

U.S. Pat. No. 3,468,041 to Mattson discloses an apparatus for removing snow, wherein a housing is included with a large inlet opening along the front side to receive snow. Additionally, a discharge outlet is included adjacent the upper center for the discharge of snow. An impeller with electric motor operates to discharge the snow out and away from the apparatus. Unfortunately, this prior art reference does not disclose a rechargeable battery source, nor an auxiliary snow intake section employable to gather snow from areas of limited space.

U.S. Pat. No. 4,190,972 to Berner discloses a very light weight portable single stage snow remover which is electrically powered. Such a snow remover can be operated and manipulated in a sideways swinging fashion in the manner of a broom and can handle normally difficult areas to clean such as steps and patios. In addition, the snow remover can conveniently and easily be used in larger areas such as driveways and sidewalks, and can be pushed forward along the surface to be cleaned without having to swing the unit when forward movement is more desirable than sideward movement. The snow remover comprises a bladed rotor which operates within a housing and is rotated by an electric motor, the blades of the rotor throwing the snow rearwardly and upwardly against a snow collecting and directing wall which projects the snow in the direction desired. There is a direct drive relationship between the rotor and the motor and the entire motor-rotor housing is connected with a handle which is selectively adjustable relative to the direction of throw of the rotor. Unfortunately, this prior art reference does not disclose a means of removing snow from higher areas such as railings and ledges, and the required swinging method may be difficult for users with limited strength.

U.S. Pat. No. 6,170,179 to Paytas discloses a snow thrower including a rotatable wheel for collecting the snow and a chute for throwing the snow away from the snow thrower. The snow thrower includes a motor and a battery connected thereto for providing power to the motor, which in turn drives a drive belt to rotate the rotatable wheel. The battery may be removed and replaced by sliding it out of the thrower housing, and further includes spring biased contacts between the housing and battery terminals to cause electrical connection therebetween. Unfortunately, this prior art reference does not disclose a vacuum mechanism to collect snow from an auxiliary means other than the front snow plow and allow for removal of snow from a variety of surfaces.

Accordingly, a need remains for a rechargeable snow removal device in order to overcome the above-noted shortcomings. The present invention satisfies such a need by providing a device that is convenient and easy to use, is durable yet lightweight in design, is versatile in its applications, and provides a means for displacing snow from a variety of locations.

BRIEF SUMMARY OF THE INVENTION

In view of the foregoing background, it is therefore an object of the present invention to provide a device for displacing snow from a variety of locations. These and other objects, features, and advantages of the invention are provided by a rechargeable snow removal device.

A rechargeable snow removal device for displacing snow from a variety of locations may include a portable frame preferably having a plurality of wheels rotatably connected thereto. Further, the snow removal device may include a primary snow intake section connected to a front end of the frame and a power-actuated vacuum mechanism connected to the primary snow intake section for siphoning snow into the primary snow intake section. One skilled in the art understands that the vacuum mechanism may include an impeller, turbine, or other type of motorized rotary to channel the snow. In addition, an exhaust nozzle may be included and in fluid communication with the vacuum mechanism for discharging snow along a scattered path away from the frame. Also, the device may include a first power source and a second power source, each selectively coupled to the vacuum mechanism. The snow removal device may come in a variety of sizes with multiple variations as to the width of the snow intake section, configuration of augers and impeller therein, and maximum horsepower output.

The rechargeable snow removal device may further include a mechanism for automatically directing power from the second power source to the vacuum mechanism and immediately thereafter interrupting power from the first power source to the vacuum mechanism. In this manner, the vacuum mechanism may continuously receive power from at least one of the first and second power sources and may thereby remain at an operating mode when one of the first and second power sources runs out of power. The first power source may include a power cord adapted to be removably mated to an existing power outlet, while the second power source may include a rechargeable battery mounted to the frame.

Thus, a user may employ the power cord while operating the snow removal device in their home driveway, and may unplug the power cord to utilize the device at a greater distance from the house without interrupting the operation. This is vital and advantageous in allowing a user to cover larger areas of snow covered ground without having to stop and change power outlets, thereby reducing the amount of time required in performing the task in icy, unfavorable outdoor conditions.

The rechargeable snow removal device further may include an auxiliary snow intake section coupled to the vacuum mechanism and spaced from the primary snow intake section. Such an auxiliary snow intake section may channel snow upstream to the vacuum mechanism and out from the exhaust nozzle. While the primary snow intake section may include a blade with a plurality of augers to break up the snow and pull it inward, the auxiliary snow intake section may include a flexible hose with interchangeable end pieces capable of reaching and pulling in snow in areas in which the primary snow intake section may not fit. The auxiliary intake section advantageously permits the user to remove snow from tight areas such as steps and doorways, where ice may later form and become dangerous.

The automatic power directing and interrupting mechanism may further include a user interface and a power selection and distribution interface. Such a power selection distribution interface may be electrically coupled directly to the user interface and the vacuum mechanism, as well as the first and second power sources respectively. In operation, the user interface may generate and transmit a plurality of input signals upon receiving a plurality of respective user inputs. This may permit the power selection and distribution interface to communicate with the vacuum mechanism when the rechargeable snow removing device is at an operating mode. The power and distribution interface may operate to direct which power source supplies the device, alternating between AC power when it is available, and the onboard rechargeable battery in times when the device may not be plugged in to an outlet.

The power selection and distribution interface may additionally include a first sensor electrically coupled directly to the first power source and a second sensor electrically coupled directly to the second power source. The first and second sensors may generate and transmit first and second power status signals associated with corresponding power levels remaining in the first and second power sources respectively. Each of the first and second power status signals may be true when the first and second power sources have at least a minimum quantity of power stored therein respectively. Further, each of the first and second power status signals may be false when the first and second power sources do not have at least the minimum quantity of power stored therein respectively. The minimum quantity of power may be equal to a minimum requisite voltage level required to operate the vacuum mechanism. Therefore, when the power level drops below the requisite amount necessary for operation of the device, the sensors may signal the power selection and distribution interface to switch to the alternate source, thereby advantageously preventing the need to find a new outlet to reach other areas in need of snow removal.

The power selection and distribution interface may further include a logic gate electrically coupled directly to each of the first and second sensors respectively. Such a logic gate may receive the first and second power status signals and thereafter generate and transmit a control output signal corresponding to a respective value of the first and second power status signals respectively. The control output signal may be true when either one of the first and second power status signal values are true. The control output signal may be false when both of the first and second power status signal values are false. The logic gate, therefore, may advantageously operate to switch between power sources based on the signals generated and transmitted therefrom.

The power selection and distribution interface further may include a main toggle switch electrically coupled directly to the logic gate and the user interface respectively. Such a main toggle switch may be selectively coupled to the first and second power sources and further may be located upstream therefrom respectively. Additionally, the main toggle switch may be responsive to one of the input signals such that the main toggle switch may be biased between closed and open positions when the user toggles the vacuum mechanism between the operating and non-operating modes respectively. Further, the control output signal may be permitted and prohibited from flowing downstream of the main toggle switch when the main toggle switch is biased to the closed and open positions respectively. Thus, a user may stop power from both sources simply by inputting a command, such as a power on/off switch, on the user interface.

The power selection and distribution interface further may include a primary toggle switch electrically coupled to the first power source and the main toggle switch respectively. Additionally, an auxiliary toggle switch may be included and electrically coupled to the second power source and the main toggle switch respectively. Each of the primary and auxiliary toggle switches may be located downstream of the main toggle switch and may be selectively coupled to the vacuum mechanism when biased to corresponding closed positions respectively. In addition, the control output signal may be permitted and prohibited from reaching the primary and auxiliary toggle switches when the main toggle switch is at the closed and open positions respectively.

Further, a true control output signal may bias the primary toggle switch to a closed position and bias the auxiliary toggle switch to an open position. A false control output signal may bias the primary toggle switch to an open position and may bias the auxiliary toggle switch to a closed position. In operation, when the user toggles the main switch to permit power, the logic gate may generate the signal based on the sensor readings to open and close the primary and auxiliary switches according to which power source is preferred. The AC power source may be first utilized, but when a user unplugs the power cord, the signal generated by the sensor will direct the logic gate to open the primary switch and close the auxiliary switch to thereby channel power from the rechargeable battery to the vacuum mechanism.

The vacuum mechanism may further include an air pump selectively coupled to the primary and auxiliary toggle switches for continuously receiving power from at least one of the first and second power sources respectively when the main toggle switch is at the closed position. Additionally, a sensor may be included and electrically coupled to the user interface for detecting an operating mode of the vacuum mechanism based upon receiving one of the input signals from the user interface.

Further, the vacuum mechanism may include primary and auxiliary conduits in fluid communication with the air pump respectively. Such primary and auxiliary conduits further may be directed along mutually exclusive paths respectively.

The primary and auxiliary snow intake sections may be in fluid communication with the primary and auxiliary conduits respectively and may thereby permit a user to selectively draw in snow from separate locations.

In operation, the user may determine which intake section to employ by inputting a command on the user interface, such as a switch between the primary to auxiliary sections, to thereby direct the air pump to pull in snow from whichever intake section is desired. This is vital and advantageous in that a user may use the primary intake section blade and augers to bring in snow on a driveway, and then switch to the auxiliary intake hose to collect snow on the front porch steps.

The vacuum mechanism further may include primary and auxiliary valves situated within the primary and auxiliary conduits respectively. Each of the primary and auxiliary valves may be intermediately situated between the air pump and the primary and auxiliary snow intake sections respectively. In addition, the operating mode sensor may generate and transmit a valve control signal to each of the primary and auxiliary valves to thereby bias the primary and auxiliary valves between open and closed positions corresponding to the operating mode identified by one of the input signals. Thus, when the user decides to operate the auxiliary snow intake section, inputting a command on the user interface may direct the operating mode sensor to close the valve of the primary intake section and open the auxiliary valve. This is vital and advantageous in that the full power of the air pump may be directed to the desired intake section, allowing a more powerful intake force to be generated to assist in collecting snow.

The present invention may further include a method for displacing snow from a variety of locations. Such a method may include the chronological steps of first providing a portable frame preferably having a plurality of wheels rotatably connected thereto. A second step of the method may be providing and connecting a primary snow intake section to a front end of the frame. Third, the method may entail providing and connecting a power-actuated vacuum mechanism to the primary snow intake section for siphoning snow into the primary snow intake section.

Next, the method may include providing and fluidly communicating an exhaust nozzle with the vacuum mechanism for discharging snow along a scattered path away from the frame. A fifth step may include providing and selectively coupling a first power source to the vacuum mechanism. Sixth, the method may entail providing and selectively coupling a second power source to the vacuum mechanism. Finally, a seventh step may include automatically directing power from the second power source to the vacuum mechanism and immediately thereafter interrupting power from the first power source to the vacuum mechanism. This may operate so that the vacuum mechanism may continuously receive power from at least one of the first and second power sources and may thereby remain at an operating mode when one of the first and second power sources runs out of power. The first power source may include a power cord adapted to be removably mated to an existing power outlet while the second power source may include a rechargeable battery mounted to the frame.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
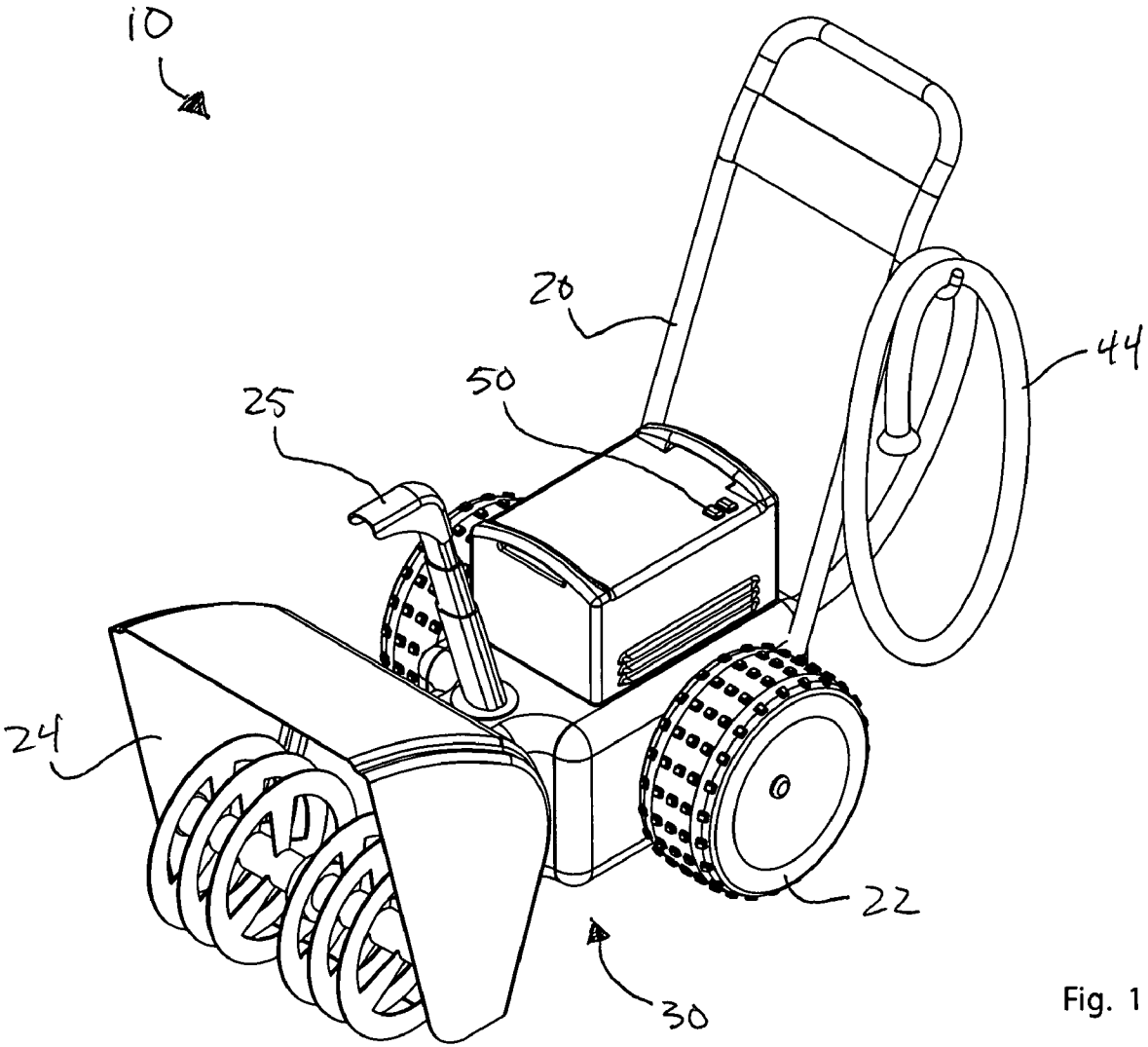
FIG. 1 is a perspective view showing a rechargeable snow removal device, in accordance with the present invention.
Figure 2:
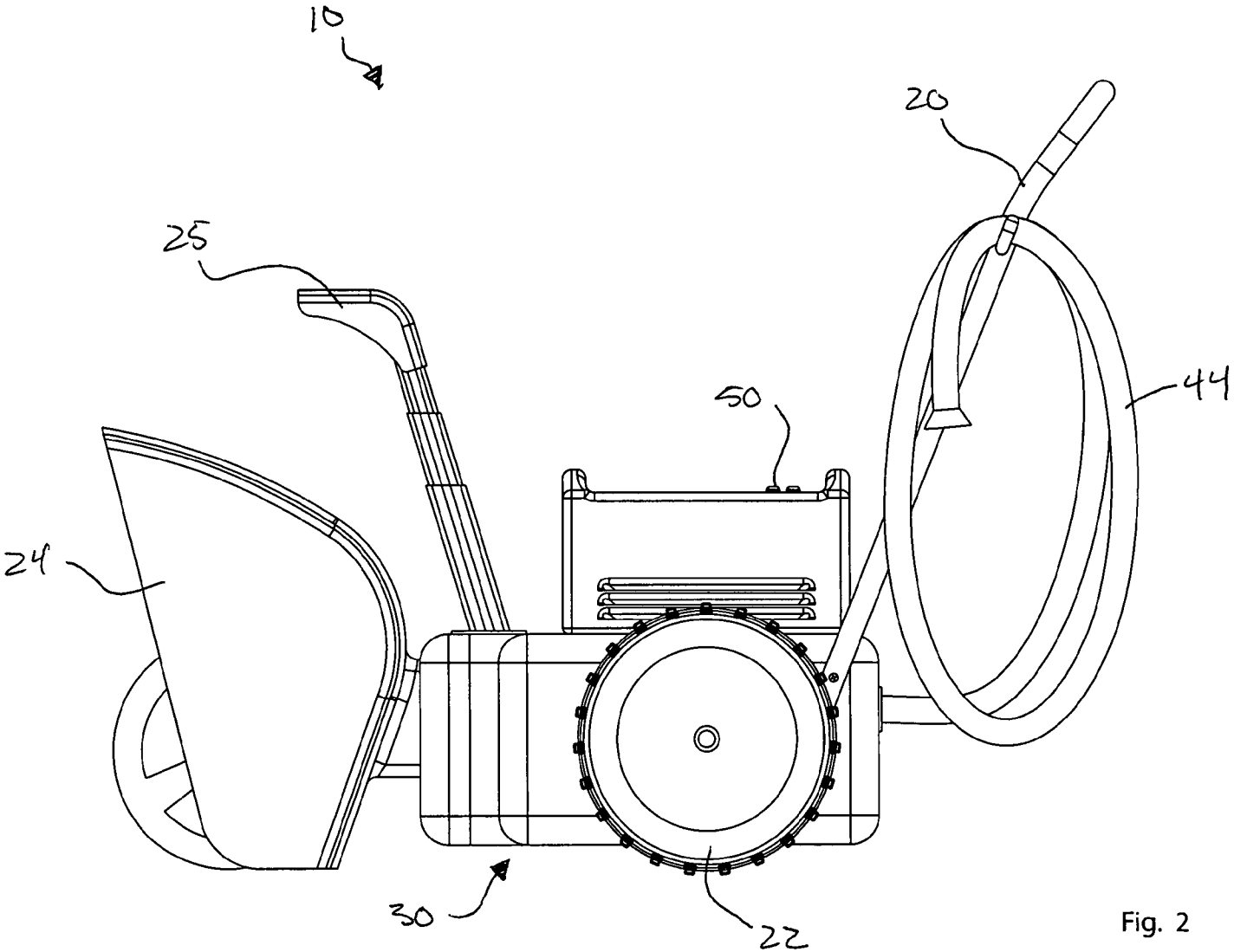
FIG. 2 is a side elevational view of the device shown in FIG. 1.
Figure 3:
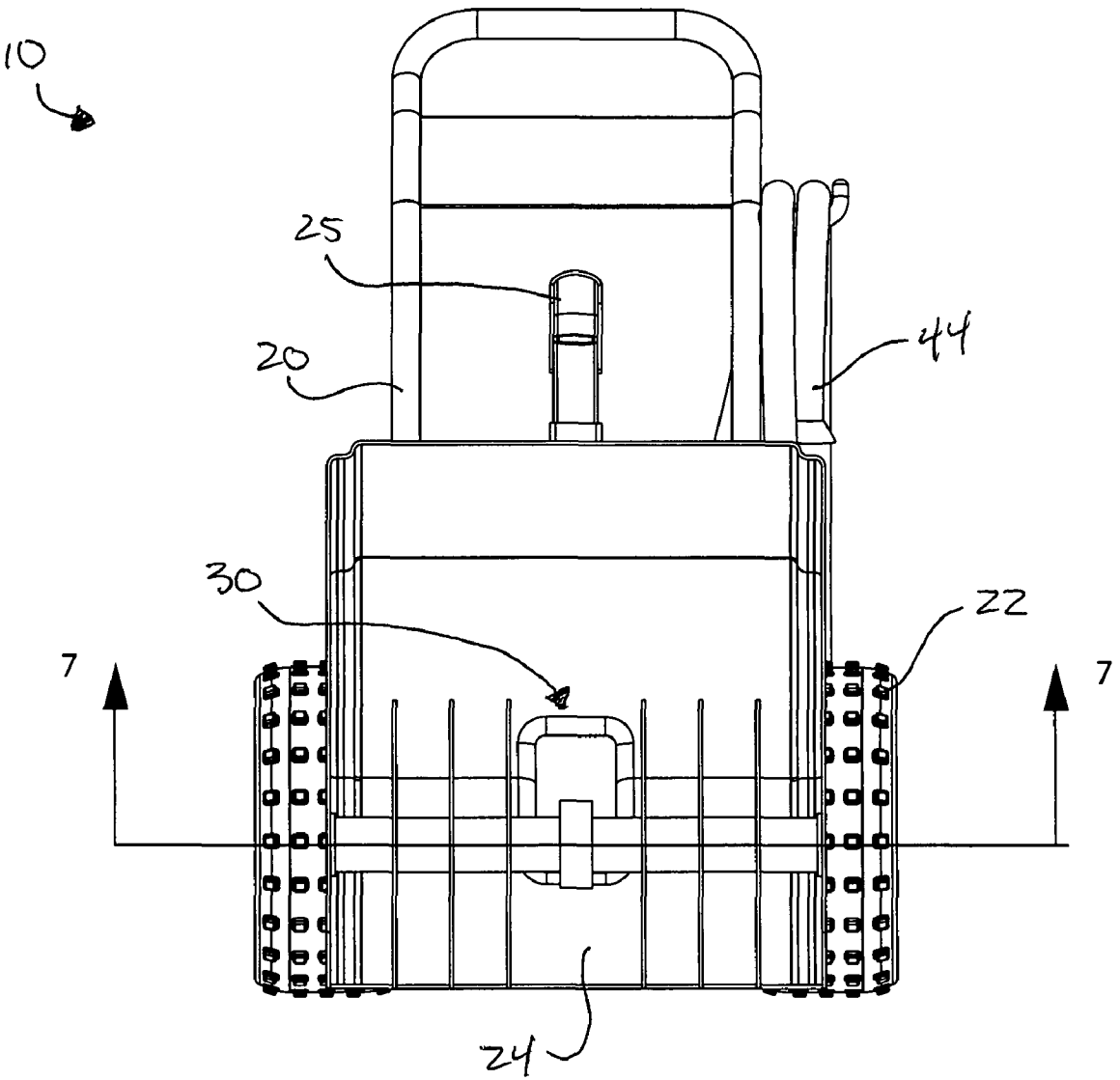
FIG. 3 is a front elevational view of the device shown in FIG. 1.
Figure 4:
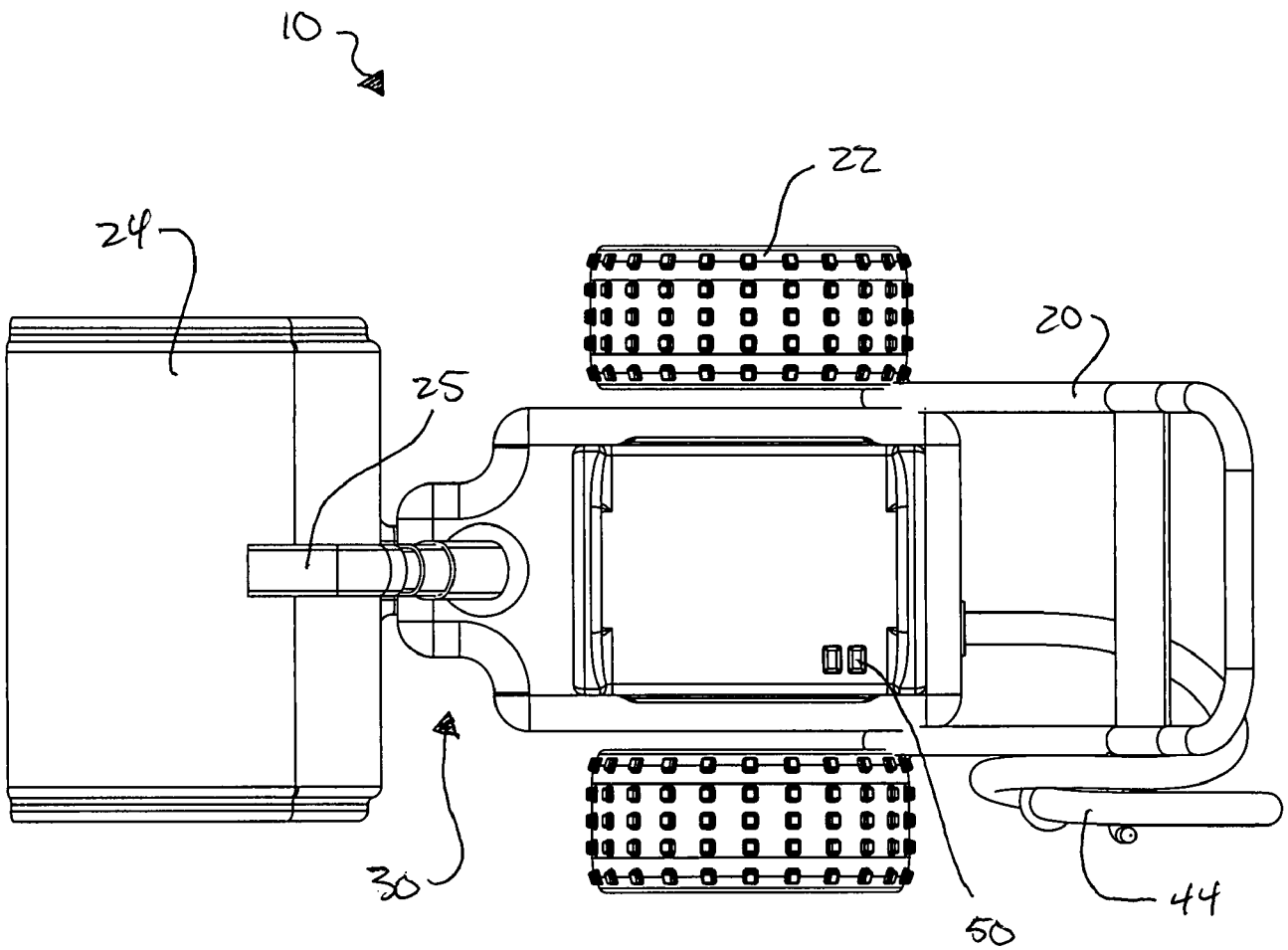
FIG. 4 is a top plan view of the device shown in FIG. 1.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The device of this invention is referred to generally in FIGS. 1-7 by the reference numeral 10 and is intended to provide a rechargeable snow removal device. It should be understood that the rechargeable snow removal device 10 may be used to remove snow from many different types of locations and on many different surface areas, including driveways, sidewalks, yards, and decks, and should not be limited by the uses described herein.

Referring initially to FIGS. 1-7, a rechargeable snow removal device 10 for displacing snow from a variety of locations may include a portable frame 20 preferably having a plurality of wheels 22 rotatably connected thereto. Further, the snow removal device 10 may include a primary snow intake section 24 connected to a front end of the frame 20 and a power-actuated vacuum mechanism 30 connected to the primary snow intake section 24 for siphoning snow into the primary snow intake section 24. One skilled in the art understands that the vacuum mechanism 30 may include an impeller, turbine, or other type of rotary to channel the snow.

In addition, an exhaust nozzle 25 may be included and in fluid communication with the vacuum mechanism 30 for discharging snow along a scattered path away from the frame 20. Also, the device 10 may include a first power source 26 and a second power source 28, each selectively coupled to the vacuum mechanism 30. The snow removal device 10 may come in a variety of sizes with multiple variations as to the width of the primary intake section 24, configuration of augers and impeller therein, and maximum horsepower output.

Figure 5:
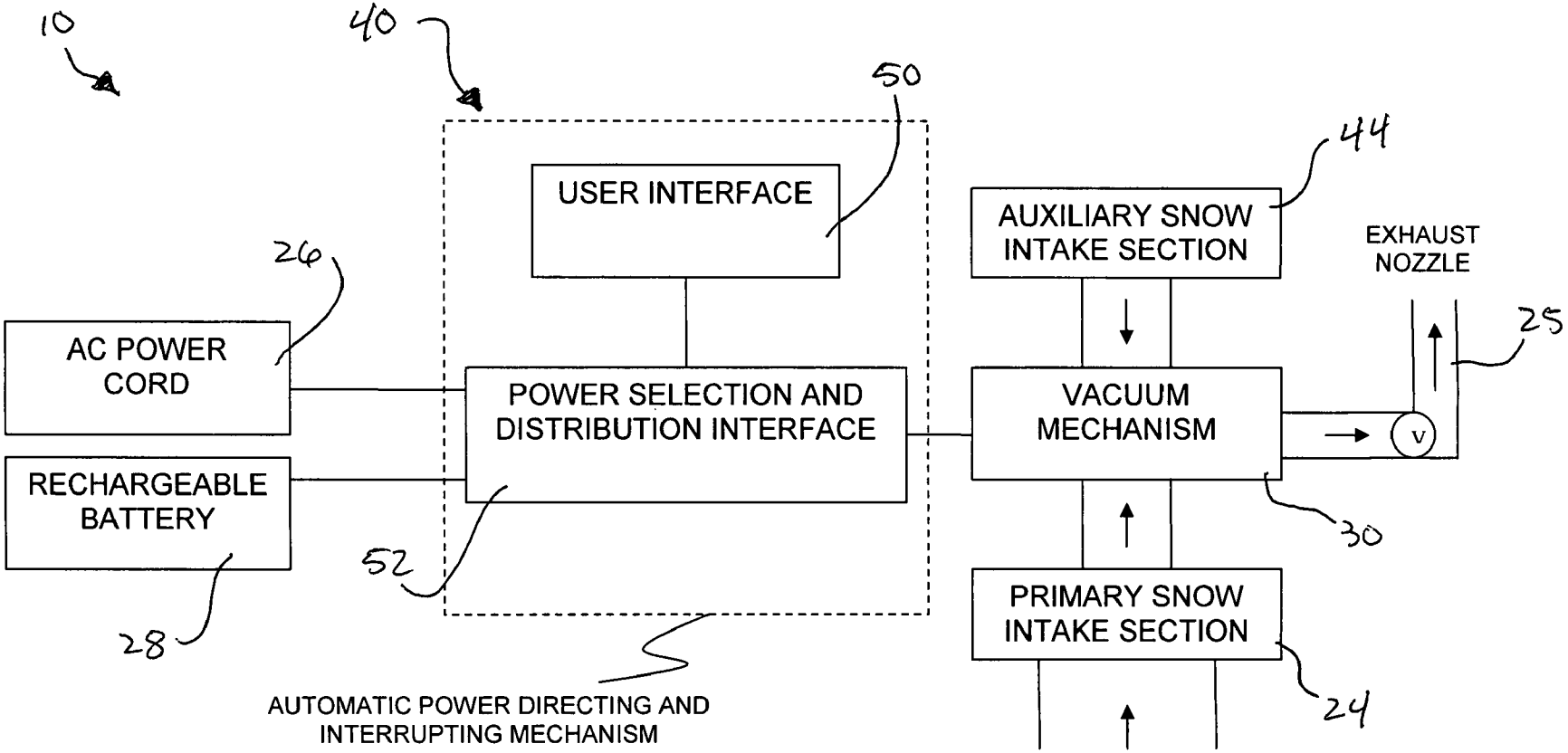
FIG. 5 is a high-level schematic block diagram of the device shown in FIG. 1, illustrating the automatic power directing and interrupting mechanism electrically coupled to the power sources and vacuum mechanism.
Figure 6:
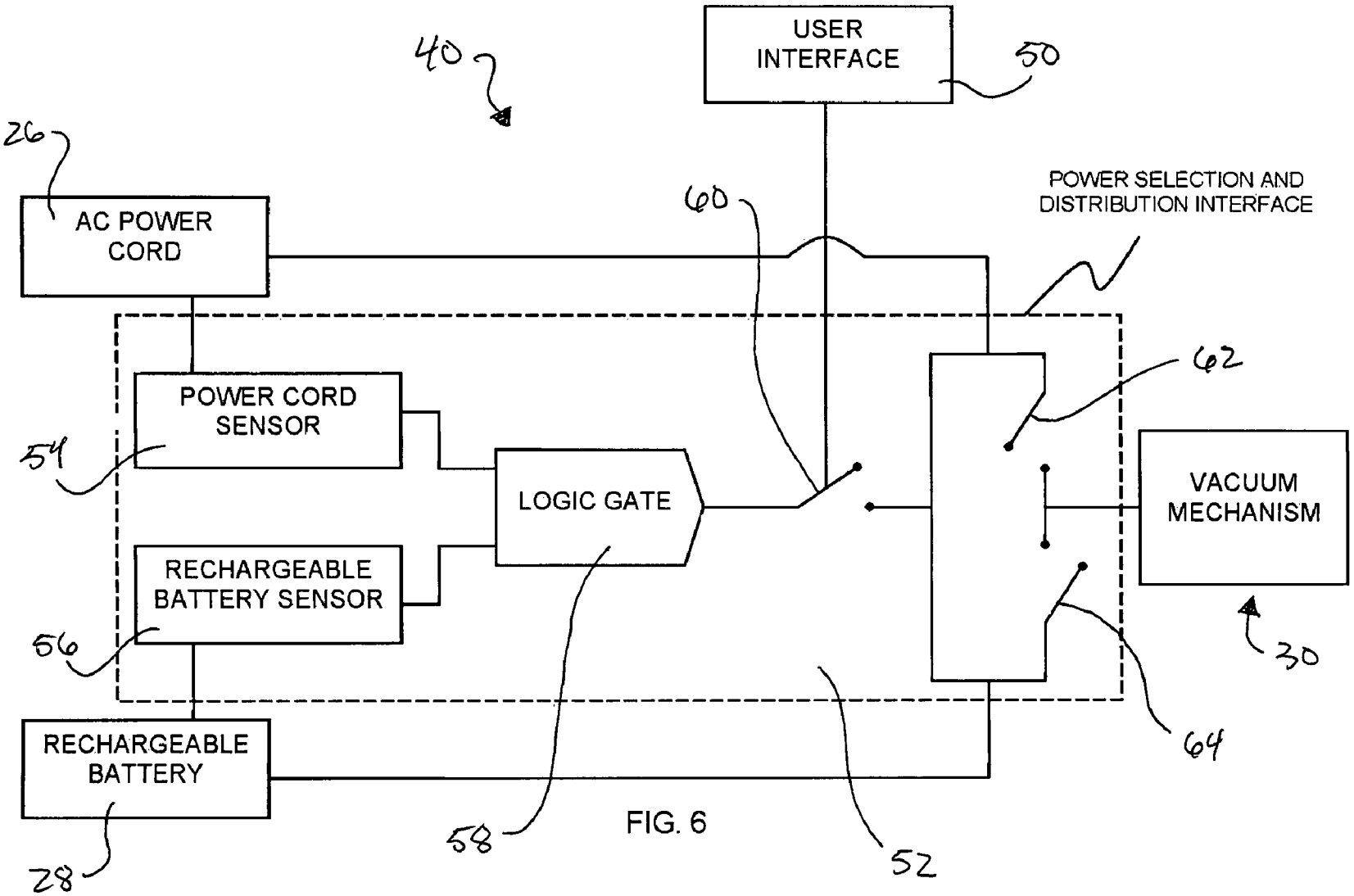
FIG. 6 is a schematic block diagram of the device shown in FIG. 1, illustrating the interrelationship between the electrical components of the power selection and distribution interface; and, FIG. 7 is a block diagram showing the uptake and discharge of snow, with respect to the operation of the vacuum mechanism.

Referring now to FIGS. 5 and 6, the rechargeable snow removal device 10 may further include a mechanism 40 for automatically directing power from the second power source 28 to the vacuum mechanism 30 and immediately thereafter interrupting power from the first power source 26 to the vacuum mechanism 30. In this manner, the vacuum mechanism 30 may continuously receive power from at least one of the first and second power sources 26, 28 and may thereby remain at an operating mode when one of the first and second power sources 26, 28 runs out of power.

The first power source 26 may include an AC power cord adapted to be removably mated to an existing power outlet, while the second power source 28 may include a rechargeable battery mounted to the frame 20. Thus, a user may employ the power cord 26 while operating the snow removal device 10 in their home driveway, and may unplug the power cord 26 to utilize the device 10 at a greater distance from the house without interrupting the operation. These elements, as claimed, provide the unexpected and unpredictable result of allowing a user to cover larger areas of snow covered ground without having to stop and change power outlets, thereby reducing the amount of time required in performing the task in icy, unfavorable outdoor conditions.

Now referring to FIGS. 1-5, the rechargeable snow removal device 10 further may include an auxiliary snow intake section 44 coupled to the vacuum mechanism 30 and spaced from the primary snow intake section 24. Such an auxiliary snow intake section may channel snow upstream to the vacuum mechanism 30 and out from the exhaust nozzle 25. While the primary snow intake section 24 may include a blade with a plurality of augers to break up the snow and pull it inward, the auxiliary snow intake section 44 may include a flexible hose with interchangeable end pieces capable of reaching and pulling in snow in areas in which the primary snow intake section 24 may not fit. Similar to a standard vacuum cleaner hose, the auxiliary intake section 44 may advantageously permit the user to remove snow from tight areas such as steps and doorways, where ice may later form and become dangerous. The combination of the primary and auxiliary snow intake sections 24, 44 provides an unpredictable and unexpected result that is not rendered obvious by one skilled in the art.

Referring now to FIGS. 5 and 6, the automatic power directing and interrupting mechanism 40 may further include a user interface 50 and a power selection and distribution interface 52. Such a power selection distribution interface 52 may be electrically coupled directly to the user interface 50 and the vacuum mechanism 30, as well as the first and second power sources 26, 28 respectively. In operation, the user interface 50 may generate and transmit a plurality of input signals upon receiving a plurality of respective user inputs. This may permit the power selection and distribution interface 52 to communicate with the vacuum mechanism 30 when the rechargeable snow removing device 10 is at an operating mode. The power and distribution interface 52 may advantageously operate to direct which power source supplies the device 10, alternating between AC power 26 when it is available, and the onboard rechargeable battery 28 in times when the device 10 may not be plugged in to an outlet.

Referring specifically to FIG. 6, the power selection and distribution interface 52 may additionally include a first sensor 54 electrically coupled directly to the first power source 26 and a second sensor 56 electrically coupled directly to the second power source 28. The first and second sensors 54, 56 may generate and transmit first and second power status signals associated with corresponding power levels remaining in the first and second power sources 26, 28 respectively. Each of the first and second power status signals may be true when the first and second power sources 26, 28 have at least a minimum quantity of power stored therein respectively.

Further, each of the first and second power status signals may be false when the first and second power sources 26, 28 do not have at least the minimum quantity of power stored therein respectively. The minimum quantity of power may be equal to a minimum requisite voltage level required to operate the vacuum mechanism 30. Therefore, when the power level drops below the requisite amount necessary for operation of the device 10, the sensors 54, 56 may signal the power selection and distribution interface 52 to switch to the alternate source, thereby advantageously preventing the need to find a new outlet to reach other areas in need of snow removal. One skilled in the art understands that such minimum quantity of power may vary depending on the size and type of motor employed by the present invention. The present invention is not intended to be limited to any particular minimum quantity of power.

Again referring to FIG. 6, the power selection and distribution interface 52 may further include a logic gate 58 electrically coupled directly to each of the first and second sensors 54, 56 respectively. Such a logic gate 58 may receive the first and second power status signals and thereafter generate and transmit a control output signal corresponding to a respective value of the first and second power status signals respectively. The control output signal may be true when either one of the first and second power status signal values are true. The control output signal may be false when both of the first and second power status signal values are false. The logic gate 58, therefore, advantageously operates to switch between power sources 26, 28 based on the signals generated and transmitted therefrom. The true and false signal may be identified by alternating voltage levels, for example.

Referring again to FIG. 6, the power selection and distribution interface 52 further may include a main toggle switch 60 electrically coupled directly to the logic gate 58 and the user interface 50 respectively. Such a main toggle switch 60 may be selectively coupled to the first and second power sources 26, 28 and further may be located upstream therefrom respectively. Additionally, the main toggle switch 60 may be responsive to one of the input signals such that the main toggle switch 60 may be biased between closed and open positions when the user toggles the vacuum mechanism 30 between the operating and non-operating modes respectively. Further, the control output signal may be permitted and prohibited from flowing downstream of the main toggle switch 60 when the main toggle switch 60 is biased to the closed and open positions respectively. Thus, a user may stop power from both sources 26, 28 simply by inputting a command, such as a power on/off switch, on the user interface 50.

Still referring to FIG. 6, the power selection and distribution interface 52 further may include a primary toggle switch 62 electrically coupled to the first power source 26 and the main toggle switch 60 respectively. Additionally, an auxiliary toggle switch 64 may be included and electrically coupled to the second power source 28 and the main toggle switch 60 respectively. Each of the primary and auxiliary toggle switches 62, 64 may be located downstream of the main toggle switch 60 and may be selectively coupled to the vacuum mechanism 30 when biased to corresponding closed positions respectively. In one embodiment, the auxiliary toggle switches 62, 64 may pivot to default open positions when the primary toggle switch 60 is at an open position.

In addition, the control output signal may be permitted and prohibited from reaching the primary and auxiliary toggle switches 62, 64 when the main toggle switch 60 is at the closed and open positions respectively. Further, a true control output signal may bias the primary toggle switch 62 to a closed position and bias the auxiliary toggle switch 64 to an open position. A false control output signal may bias the primary toggle switch 62 to an open position and may bias the auxiliary toggle switch 64 to a closed position.

In operation, when the user toggles the main switch 60 to permit power, the logic gate 58 may generate the signal based on the signals to open and close the primary and auxiliary switches 62, 64 according to which power source 26, 28 is preferred. The AC power source 26 may be first utilized, but when a user unplugs the power cord 26, the signal generated by the sensor 54 will direct the logic gate 58 to open the primary switch 62 and close the auxiliary switch 64 to thereby channel power from the rechargeable battery 28 to the vacuum mechanism 30.

Figure 7:
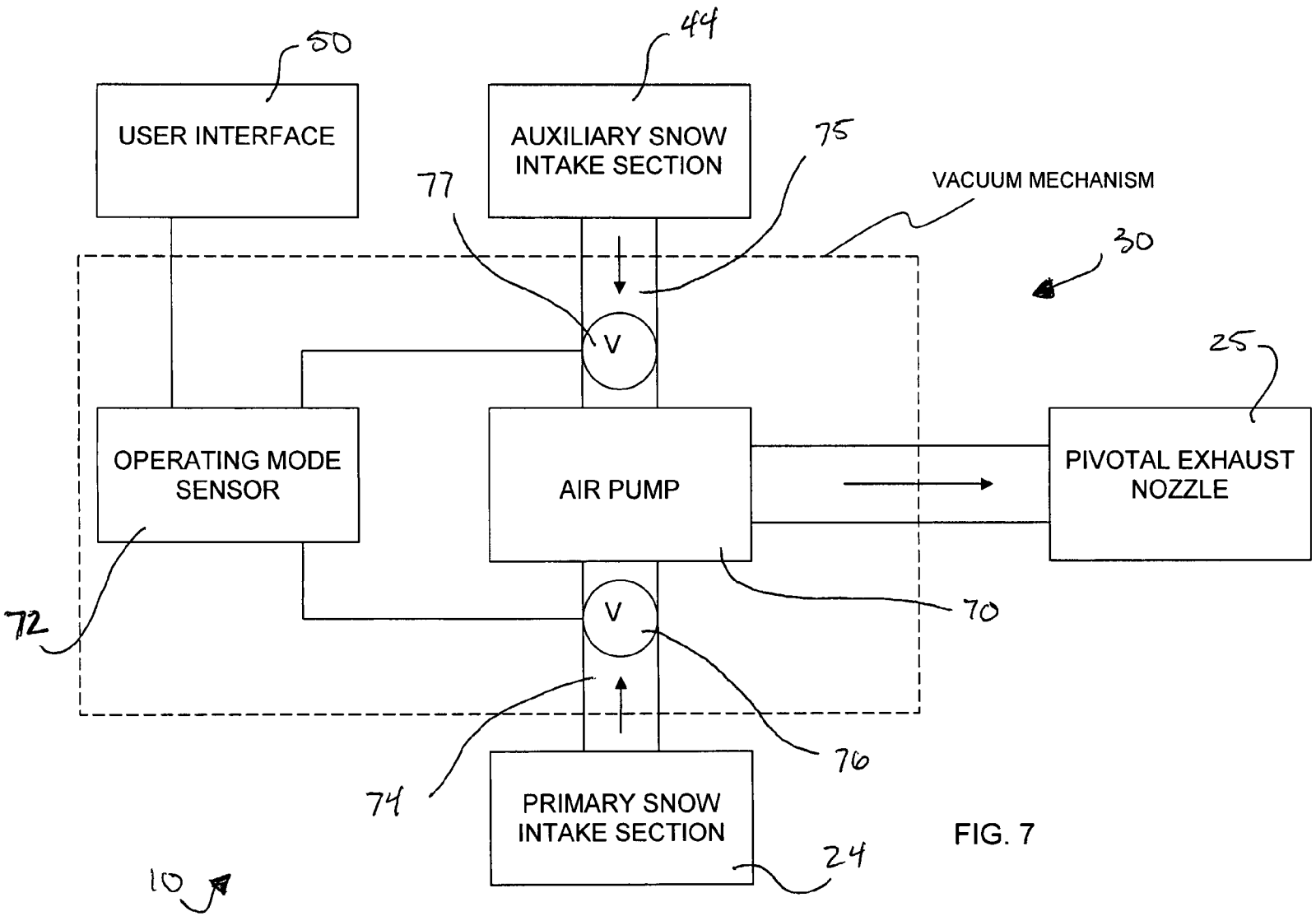

Now referring to FIG. 7, the vacuum mechanism 30 may further include an air pump 70 selectively coupled to the primary and auxiliary toggle switches 62, 64 for continuously receiving power from at least one of the first and second power sources 26, 28 respectively when the main toggle switch 60 is at the closed position. Additionally, a sensor 72 may be included and electrically coupled to the user interface 50 for detecting an operating mode of the vacuum mechanism 30 based upon receiving one of the input signals from the user interface 50.

Further, the vacuum mechanism 30 may include primary and auxiliary conduits 74, 75 in fluid communication with the air pump 70 respectively. Such primary and auxiliary conduits 74, 75 further may be directed along mutually exclusive paths respectively. The primary and auxiliary snow intake sections 24, 44 may be in fluid communication with the primary and auxiliary conduits 74, 75 respectively and may thereby permit a user to selectively draw in snow from separate locations.

In operation, the user may determine which intake section 24, 44 to employ by inputting a command on the user interface 50, such as a switch between the primary to auxiliary sections 24, 44, to thereby direct the air pump 70 to pull in snow from whichever intake section 24, 44 is desired. This is vital and advantageous in that a user may use the primary intake section 24 with blade and augers to bring in snow on a driveway, and then switch to the auxiliary intake 44 with hose to collect snow on the front porch steps.

Referring again to FIG. 7, the vacuum mechanism 30 further may include primary and auxiliary valves 76, 77 situated within the primary and auxiliary conduits 74, 75 respectively. Each of the primary and auxiliary valves 76, 77 may be intermediately situated between the air pump 70 and the primary and auxiliary snow intake sections 24, 44 respectively. In addition, the operating mode sensor 72 may generate and transmit a valve control signal to each of the primary and auxiliary valves 76, 77 to thereby bias the primary and auxiliary valves 76, 77 between open and closed positions corresponding to the operating mode identified by one of the input signals.

Thus, when the user decides to operate the auxiliary snow intake section 44, inputting a command on the user interface 50 may direct the operating mode sensor 72 to close the valve 76 of the primary conduit 74 and open the auxiliary valve 77 of the auxiliary conduit 75. This is vital and advantageous in that the full power of the air pump 70 may be directed to the desired intake section 24, 44, allowing a more powerful intake force to be generated to assist in collecting snow.

Referring again to FIGS. 1-7 in general, the present invention 10 may further include a method for displacing snow from a variety of locations. Such a method may include the chronological steps of first providing a portable frame 20 preferably having a plurality of wheels 22 rotatably connected thereto. A second step of the method may be providing and connecting a primary snow intake section 24 to a front end of the frame 20. Third, the method may entail providing and connecting a power-actuated vacuum mechanism 30 to the primary snow intake section 24 for siphoning snow into the primary snow intake section 24.

Next, the method may include providing and fluidly communicating an exhaust nozzle 25 with the vacuum mechanism 30 for discharging snow along a scattered path away from the frame 20. A fifth step may include providing and selectively coupling a first power source 26 to the vacuum mechanism 30. Sixth, the method may entail providing and selectively coupling a second power source 28 to the vacuum mechanism 30.

Finally, a seventh step may include automatically directing power from the second power source 28 to the vacuum mechanism 30 and immediately thereafter interrupting power from the first power source 26 to the vacuum mechanism 30. This may operate so that the vacuum mechanism 30 may continuously receive power from at least one of the first and second power sources 26, 28 and may thereby remain at an operating mode when one of the first and second power sources 26, 28 runs out of power. The first power source 26 may include an AC power cord adapted to be removably mated to an existing power outlet while the second power source 28 may include a rechargeable battery mounted to the frame 20.

The method provides an unpredictable and unexpected result of assisting a user to remove snow from a variety of locations and in areas of limited space, which is not rendered obvious by one skilled in the art. The primary snow intake section 24 may remove large quantities of snow from larger surfaces such as driveways, sidewalks, and decks. The auxiliary snow intake section 44, on the other hand, may remove snow from tighter areas such as porch steps, railings, flower beds and the like. These elements, as claimed, allow a user to remove snow quickly and easily, to thereby reduce the amount of time required to be spent working in cold and icy conditions.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A rechargeable snow removal device for displacing snow from a variety of locations, said rechargeable snow removal device comprises:

a frame;

a primary snow intake section connected to said frame;

a power-actuated vacuum mechanism connected to said primary snow intake section for siphoning snow into said primary snow intake section;

an exhaust nozzle in fluid communication with said vacuum mechanism for discharging snow along a scattered path away from said frame;

a first power source selectively coupled to said vacuum mechanism;

a second power source selectively coupled to said vacuum mechanism;

means for automatically directing power from said second power source to said vacuum mechanism and immediately thereafter interrupting power from said first power source to said vacuum mechanism so that said vacuum mechanism continuously receives power from at least one of said first and second power sources and thereby remains at an active operating mode when one of said first and second power sources runs out of power;

an auxiliary snow intake section coupled to said vacuum mechanism and spaced from said primary snow intake section, said auxiliary snow intake section for channeling snow upstream to said vacuum mechanism and out from said exhaust nozzle;

wherein said automatic power directing and interrupting means comprises:

a user interface;

a power selection and distribution interface electrically coupled directly to said user interface and said vacuum mechanism as well as said first and second power sources respectively;

wherein said user interface generates and transmits a plurality of input signals upon receiving a plurality of respective user inputs for permitting said power selection and distribution interface to communicate with said vacuum mechanism when said rechargeable snow removing device is at an operating mode;

wherein said power selection and distribution interface comprises:

a first sensor electrically coupled directly to said first power source; and a second sensor electrically coupled directly to said second power source; and wherein said first and second sensors generate and transmit first and second power status signals associated with corresponding power levels remaining in said first and second power sources respectively;

wherein each of said first and second power status signals are true when said first and second power sources have at least a minimum quantity of power stored therein respectively;

wherein each of said first and second power status signals are false when said first and second power sources do not have at least the minimum quantity of power stored therein respectively;

wherein the minimum quantity of power is equal to a minimum requisite voltage level to operate said vacuum mechanism.

2. The rechargeable snow removal device of claim 1, wherein said power selection and distribution interface further comprises:

a logic gate electrically coupled directly to each of said first and second sensors respectively, said logic gate receiving said first and second power status signals and thereafter generating and transmitting a control output signal corresponding to a respective value of said first and second power status signals respectively;

wherein said control output signal is true when either one of said first and second power status signal values are true;

wherein said control output signal is false when both of said first and second power status signal values are false.

3. The rechargeable snow removal device of claim 2, wherein said power selection and distribution interface further comprises:

a main toggle switch electrically coupled directly to said logic gate and said user interface respectively, said main toggle switch being selectively coupled to said first and second power sources and further being located upstream therefrom respectively, said main toggle switch being responsive to one of said input signals such that said main toggle switch is biased between closed and open positions when the user toggles said vacuum mechanism between the operating and non-operating modes respectively, said control output signal being permitted and prohibited from flowing downstream of said main toggle switch when said main toggle switch is biased to the closed and open positions respectively.

4. The rechargeable snow removal device of claim 3, wherein said power selection and distribution interface further comprises:

a primary toggle switch electrically coupled to said first power source and said main toggle switch respectively; and an auxiliary toggle switch electrically coupled to said second power source and said main toggle switch respectively;

wherein each of said primary and auxiliary toggle switches are located downstream of said main toggle switch and are further selectively coupled to said vacuum mechanism when biased to corresponding closed positions respectively;

wherein said control output signal is permitted and prohibited from reaching said primary and auxiliary toggle switches when said main toggle switch is at the closed and open positions respectively;

wherein a true control output signal biases said primary toggle switch to a closed position and biases said auxiliary toggle switch to an open position;

wherein a false control output signal biases said primary toggle switch to an open position and biases said auxiliary toggle switch to a closed position.

5. The rechargeable snow removal device of claim 4, wherein said vacuum mechanism comprises:

an air pump selectively coupled to said primary and auxiliary toggle switches for continuously receiving power from said at least one first and second power sources respectively when said main toggle switch is at the closed position;

a sensor electrically coupled to said user interface for detecting an operating mode of said vacuum mechanism based upon receiving of one of said input signals from said user interface; and primary and auxiliary conduits being in fluid communication with said air pump respectively and further being directed along mutually exclusive paths respectively;

wherein said primary and auxiliary snow intake sections are in fluid communication with said primary and auxiliary conduits respectively and thereby permit a user to selectively draw in snow from separate locations.

6. The rechargeable snow removal device of claim 5, wherein said vacuum mechanism further comprises:

primary and auxiliary valves situated within said primary and auxiliary conduits respectively, each of said primary and auxiliary valves being intermediately situated between said air pump and said primary and auxiliary snow intake sections respectively;

wherein said sensor generates and transmits a valve control signal to each of said primary and auxiliary valves to thereby bias said primary and auxiliary valves between open and closed positions corresponding to the operating mode identified by one of said input signals.

7. A rechargeable snow removal device for displacing snow from a variety of locations, said rechargeable snow removal device comprises:

a portable frame having a plurality of wheels rotatably connected thereto;

a primary snow intake section connected to a front end of said frame;

a power-actuated vacuum mechanism connected to said primary snow intake section for siphoning snow into said primary snow intake section;

an exhaust nozzle in fluid communication with said vacuum mechanism for discharging snow along a scattered path away from said frame;

a first power source selectively coupled to said vacuum mechanism;

a second power source selectively coupled to said vacuum mechanism;

means for automatically directing power from said second power source to said vacuum mechanism and immediately thereafter interrupting power from said first power source to said vacuum mechanism so that said vacuum mechanism continuously receives power from at least one of said first and second power sources and thereby remains at an operating mode when one of said first and second power sources runs out of power;

wherein said first power source comprises a power cord adapted to be removably mated to an existing power outlet;

wherein said second power source comprises a rechargeable battery mounted to said frame;

an auxiliary snow intake section coupled to said vacuum mechanism and spaced from said primary snow intake section, said auxiliary snow intake section for channeling snow upstream to said vacuum mechanism and out from said exhaust nozzle;

wherein said automatic power directing and interrupting means comprises:

a user interface;

a power selection and distribution interface electrically coupled directly to said user interface and said vacuum mechanism as well as said first and second power sources respectively;

wherein said user interface generates and transmits a plurality of input signals upon receiving a plurality of respective user inputs for permitting said power selection and distribution interface to communicate with said vacuum mechanism when said rechargeable snow removing device is at an operating mode;

wherein said power selection and distribution interface comprises:

a first sensor electrically coupled directly to said first power source; and a second sensor electrically coupled directly to said second power source;

wherein said first and second sensors generate and transmit first and second power status signals associated with corresponding power levels remaining in said first and second power sources respectively;

wherein each of said first and second power status signals are true when said first and second power sources have at least a minimum quantity of power stored therein respectively;

wherein each of said first and second power status signals are false when said first and second power sources do not have at least the minimum quantity of power stored therein respectively;

wherein the minimum quantity of power is equal to a minimum requisite voltage level to operate said vacuum mechanism.

8. The rechargeable snow removal device of claim 7, wherein said power selection and distribution interface further comprises:

a logic gate electrically coupled directly to each of said first and second sensors respectively, said logic gate receiving said first and second power status signals and thereafter generating and transmitting a control output signal corresponding to a respective value of said first and second power status signals respectively;

wherein said control output signal is true when either one of said first and second power status signal values are true;

wherein said control output signal is false when both of said first and second power status signal values are false.

9. The rechargeable snow removal device of claim 8, wherein said power selection and distribution interface further comprises:

a main toggle switch electrically coupled directly to said logic gate and said user interface respectively, said main toggle switch being selectively coupled to said first and second power sources and further being located upstream therefrom respectively, said main toggle switch being responsive to one of said input signals such that said main toggle switch is biased between closed and open positions when the user toggles said vacuum mechanism between the operating and non-operating modes respectively, said control output signal being permitted and prohibited from flowing downstream of said main toggle switch when said main toggle switch is biased to the closed and open positions respectively.

10. The rechargeable snow removal device of claim 9, wherein said power selection and distribution interface further comprises:

a primary toggle switch electrically coupled to said first power source and said main toggle switch respectively; and an auxiliary toggle switch electrically coupled to said second power source and said main toggle switch respectively;

wherein each of said primary and auxiliary toggle switches are located downstream of said main toggle switch and are further selectively coupled to said vacuum mechanism when biased to corresponding closed positions respectively;

wherein said control output signal is permitted and prohibited from reaching said primary and auxiliary toggle switches when said main toggle switch is at the closed and open positions respectively;

wherein a true control output signal biases said primary toggle switch to a closed position and biases said auxiliary toggle switch to an open position;

wherein a false control output signal biases said primary toggle switch to an open position and biases said auxiliary toggle switch to a closed position.

11. The rechargeable snow removal device of claim 10, wherein said vacuum mechanism comprises:

an air pump selectively coupled to said primary and auxiliary toggle switches for continuously receiving power from said at least one first and second power sources respectively when said main toggle switch is at the closed position;

a sensor electrically coupled to said user interface for detecting an operating mode of said vacuum mechanism based upon receiving of one of said input signals from said user interface; and primary and auxiliary conduits being in fluid communication with said air pump respectively and further being directed along mutually exclusive paths respectively;

wherein said primary and auxiliary snow intake sections are in fluid communication with said primary and auxiliary conduits respectively and thereby permit a user to selectively draw in snow from separate locations.

12. The rechargeable snow removal device of claim 11, wherein said vacuum mechanism further comprises:

primary and auxiliary valves situated within said primary and auxiliary conduits respectively, each of said primary and auxiliary valves being intermediately situated between said air pump and said primary and auxiliary snow intake sections respectively;

wherein said sensor generates and transmits a valve control signal to each of said primary and auxiliary valves to thereby bias said primary and auxiliary valves between open and closed positions corresponding to the operating mode identified by one of said input signals.

* * * * *